US009545703B1

(12) United States Patent
Juranitch

(10) Patent No.: US 9,545,703 B1
(45) Date of Patent: Jan. 17, 2017

(54) MINIATURE KNIFE SHARPENING APPARATUS

(71) Applicant: Joseph C. Juranitch, Babbitt, MN (US)

(72) Inventor: Joseph C. Juranitch, Babbitt, MN (US)

(73) Assignee: Razor Edge Systems, Inc., Ely, MN (US)

( * ) Notice: Subject to any disclaimer, the term of this patent is extended or adjusted under 35 U.S.C. 154(b) by 0 days.

(21) Appl. No.: 14/822,397

(22) Filed: Aug. 10, 2015

(51) Int. Cl.
*B24D 15/08* (2006.01)
*B24D 15/04* (2006.01)

(52) U.S. Cl.
CPC ..... *B24D 15/081* (2013.01); *B24D 15/04* (2013.01)

(58) Field of Classification Search
CPC ..... B24D 15/081; B24D 15/04
USPC ..... 451/486
See application file for complete search history.

(56) References Cited

U.S. PATENT DOCUMENTS 1,894,579 A * 1/1933 Blankner ..... B24D 15/081 451/486
3,861,246 A * 1/1975 Waller ..... B24D 15/081 30/138
3,885,352 A 5/1975 Juranitch
3,942,394 A 3/1976 Juranitch
4,030,254 A * 6/1977 Marcantonio ..... B24D 15/023 451/516
4,041,651 A * 8/1977 Bayly ..... B24D 15/084 451/555
4,091,691 A * 5/1978 Bayly ..... B24D 15/084 30/138
4,852,305 A 8/1989 Juranitch
4,934,110 A * 6/1990 Juranitch ..... B24D 15/081 451/486

(Continued)

OTHER PUBLICATIONS

Razor Edge Systems brochure for "Mousetrap Steel" knife sharpening product (undated).

(Continued)

*Primary Examiner* — George Nguyen
(74) *Attorney, Agent, or Firm* — DeWitt Ross & Stevens S.C.

(57) ABSTRACT

A sharpening apparatus that may be used by a relatively unskilled person to simultaneously sharpen the two opposed cutting edges of a knife blade by hand and to maintain a sharpened cutting edge along the blade with minimal effort and training is provided by the invention. The apparatus comprises a panel member with a slot partially extending from its top edge, and a pair of sharpening steels that are pivotably mounted to the panel member to swing downwards in a crossed relation across the slot. A pair of leaf spring bias the sharpening steels in their standby position. When the knife blade is moved down through the slot, it comes into contact with crossed sharpening steels to bow them outwards under tension applied by the leaf springs. The cutting edges of the knife blade are drawn along and against the sharpening steels to automatically sharpen their cutting edges at the proper angle without any need to match angles between the cutting edges of the knife and the sharpening steels, and without any counterweights applied to the sharpening steels. Such a sharpening apparatus can be used to maintain an extremely sharp cutting edge for precise cutting of a material without crushing or other damage with significantly reduced physical force and strain upon the user.

20 Claims, 10 Drawing Sheets

(56) References Cited

U.S. PATENT DOCUMENTS

| | | | | |
|---|---|---|---|---|
| 5,040,435 | A * | 8/1991 | Millman | B24D 15/081 451/486 |
| 5,290,186 | A | 3/1994 | Juranitch | |
| D358,747 | S | 5/1995 | Juranitch | |
| 5,440,953 | A * | 8/1995 | Gangelhoff | B24D 15/081 451/486 |
| 5,478,272 | A * | 12/1995 | Cozzini | B24D 15/081 451/486 |
| 5,655,959 | A | 8/1997 | Juranitch | |
| 6,679,767 | B2 * | 1/2004 | Lohnert | B24D 15/08 451/319 |
| 6,905,403 | B2 * | 6/2005 | Stallegger | B24D 15/081 451/45 |
| 7,503,241 | B2 * | 3/2009 | Dassaud | B24D 15/081 451/486 |
| 8,282,448 | B2 * | 10/2012 | Loehnert | B24B 3/54 451/486 |
| 2003/0075022 | A1 * | 4/2003 | Henry | B24D 15/081 76/82 |
| 2006/0000313 | A1 * | 1/2006 | Henry | B24D 15/081 76/86 |

OTHER PUBLICATIONS

Razor Edge Systems brochure for "Mousetrap Steel MT18C" knife sharpening product (2014).

* cited by examiner

MINIATURE KNIFE SHARPENING APPARATUS

FIELD OF INVENTION

This invention relates to an apparatus for sharpening the cutting edge of a knife blade and maintaining a sharp edge along the cutting edge, and more specifically to such an apparatus that is small, light-weight, hand-held, portable and sanitary for simultaneously sharpening and polishing the surfaces of the cutting blade of the knife without the need for a sharpening or honing wheel, or a skilled knife sharpener.

BACKGROUND OF THE INVENTION

A knife represents a hand-held cutting tool with a cutting edge or blade. It may also have a handle. Originally made from rock, bone, flint, or obsidian, knife blades today are typically fashioned from iron, steel, ceramics, or titanium.

While knives may be used as a weapon, they are more commonly employed by people as useful tools in food preparation, dining, meat processing, hunting, construction, work projects, and hobbies for cutting or slicing an object. Many different types and designs of knives are known, but most of them share the trait of one or two sharpened blade edges.

But, over time, these sharpened edges of the knife blade will become dull or damaged. Blades are damaged usually by buckling due to compressive force arising from the user pressing the knife blade edge into a hard object like bone, ice, a hard cutting board, or other hard object, or simply by repetitive use. The cutting edge may also become bent from sideways pressure applied against the blade. Both of these forces tend to roll the knife blade's cutting edge due to the ductile characteristic of the metal material used in the blade. Moreover, tougher or abrasive materials will cause the blade to become dull more quickly.

Dull blades do not cut as easily or precisely, and can create a danger to the end user by requiring greater hand force to make a cut. Moreover, dulled blades can include burrs or ragged edges with regions along the cutting surface that are out of alignment with each other. Such misaligned blades can damage the material being cut, or produce an inferior cut by tearing or sawing the material being cut as opposed to a smooth, clean cut.

Therefore, such dulled knife blades must be periodically sharpened. This is a process in which the knife blade is ground against a hard, rough surface like a stone, or a soft surface containing hard particles. Metal can be removed from the knife blade in order to form a new edge along the blade. Typically, a grinding wheel or a whetstone is used. These sharpening stones come in varying grit degrees from very coarse to very fine, and can be described as hard or soft depending upon whether the grit comes free of the stone during the grinding operation. Ceramic hones are also commonly used, especially when fine grit size is desired. Coated hones with an abrasive diamond-based surface provide yet another option. Mineral oil often is used during the grinding application to separate the loosened grinding particles from the knife blade edge to prevent damage to the blade.

The cutting edges of the knife blade may also be straightened by a sharpening steel. The sharpening steel constitutes a hardened cylindrical, triangular or other shaped rod having a small diameter. This sharpening steel may have a smooth, polished exterior surface, or may be somewhat abrasive. It may also feature slight ridges or ribs running along the length of the rod. A butcher steel constitutes a round file with teeth running the long way, although it may also be smooth. As the knife blade with its cutting edge is swiped along the sharpening steel, the steel will exert high localized pressure against the cutting edge to straighten the turned edges of the cutting edge back into proper alignment. Unlike grinding, such steeling process does not usually remove metal from the blade edge.

Knives used by barbers are often stropped after steeling in order to polish the sharpened cutting edge. This is often done with a leather strap impregnated with an abrasive compound like chromium (III) oxide particles. This operation does not remove any metal material from the blade edge, but produces a very sharp edge.

However, grinding constitutes a precise operation in which the angle of the cutting edge of the blade must match the angle of the whetstone or grinding wheel surface. The smaller the angle between the blade and stone, the sharper the knife will be, but at the same time, the less side force is required to damage the knife blade by bending the cutting edge over or even chipping it off. The edge angle represents the angle between the blade and the stone. For symmetrical double-ground, wedge-shaped knife blades, the angle from one edge to the other edge of the blade will be twice the edge angle.

While steeling represents a less aggressive form of sharpening than grinding, it still is important to swipe the knife's blade at a proper angle with respect to the sharpening steel. Moreover, the two cutting edges of the knife must be swiped the same number of times against the steel or else the cutting edge will be pushed again out of alignment.

It is therefore easy to damage the cutting edge of the knife blade further if the sharpening exercise is performed poorly. Thus, most knife users need to send out their dulled knives to a professional sharpening service, or to replace the knife with a new knife. This can be time-consuming and expensive.

Some knife users employ the bottom of a ceramic coffee mug for sharpening the blade. The course ceramic particle surface can produce acceptable results, although a sharpening steel usually must then be used. But again, a proper angle must still be maintained during the sharpening swipes. Electric knife sharpeners are also available in the market.

U.S. Pat. No. 3,942,394 issued to Juranitch in 1976 is directed to a finishing sharpener device used in the field for sharpening a knife blade. It includes a handle having a pair of wings that fold out and extend at a 30 degree angle from the handle. Each of the wings constitutes a flat bar defining a sharpening edge that is arcuate in cross section and smooth. By drawing a dulled knife blade cutting edge across the sharpening edge of one of the wings at the proper angle, the cutting edge along one side of the knife blade may be restored to its sharpened configuration. The handle of the finishing sharpener serves as a rough visual guide for properly aligning the knife handle to draw the knife blade along the wing's sharpening edge. But, this process still requires some skill by the person sharpening the knife blade to ensure a proper match between the knife blade cutting edge angle and the angled surface of the sharpening edge of the wing. Moreover, the opposing cutting edges of the knife blade must be sharpened sequentially using first the one wing and then the other wing. Simultaneous sharpening of the opposed cutting edges of the knife blade is impossible. Furthermore, when the knife blade is swiped along one of the wings to sharpen it, the blade comes very close to the user's other hand on the handle, thereby producing a risk of injury. Finally, the arcuate cross-section surface of relatively small radial extent having a highly smooth configuration is insufficient for removing material from the cutting edge of the knife blade. This finishing sharpener may only therefore be used after the knife blade has been sharpened first on a hone or grinding wheel.

Razor Edge Systems of Ely, Minn. has commercialized a knife sharpening device referred to as MOUSETRAP STEEL that is further disclosed in U.S. Pat. No. 5,655,959 issued to Juranitch in 1997. It has been used to sharpen the cutting edges of a knife blade in the meat processing industry, but also for any other end-use application where there is a need to maintain a sharp knife edge. It constitutes a bench-top mounted vertical base member having a vertical slot partially bisecting the base member from its top edge. Pivotably mounted to the base member are two counterweights having equal masses. A pair of upwardly curved sharpening steels are connected to the upper and inner ends of the counterweights and extend toward each other in a crossed relationship, intersecting at and along the slot. A pair of guard rods are needed to protect the sharpening steels from outside damaging force, further aided by guard blocks mounted to the side edge of the base member. As a knife blade is pushed down through the slot, it engages the sharpening steels at this intersection point and pushes the steels inwardly, sharpening the opposing cutting edges of the knife blade simultaneously as the knife blade is swiped along the sharpening steels. A pivotably-mounted wiper wing under the influence of its own counterweight polishes the sharpened blade. A pair of cams that are eccentrically mounted to the base member act to arrest the lateral movement of the steels during the knife sharpening operation, as well as to define the downward resting point of the counterweights when the sharpening steels are in their standby position when the knife blade is disengaged. However, these cams must be carefully adjusted in their eccentric positions along the base member prior to the knife sharpening operation to define how high or low the crossed intersection point of the steels will be situated over the slot. A higher position requires greater force applied to the knife blade during the sharpening operation resulting in this higher intersection point of the steels producing a less sharp cutting angle along the knife blade. A lower intersection position on the other hand requires less force applied to the knife blade during the sharpening operation resulting in a sharper cutting angle produced by the steels along the knife blade. Thus, the MOUSETRAP STEEL sharpener requires the user to know in advance the angle of the cutting edges that must be produced along the sharpened knife blade, and to precisely adjust in advance the cams' positions to achieve this desired angle. This requires skill and patience by the user. Yet over time, the significant weight of the heavy, 20-ounce counterweights will cause the cams to move from their intended position, thereby making repeated sharpening of knives with the same cutting edge angle impossible without further precise adjustment of the position of the cams. Furthermore, these heavy counterweights make the MOUSETRAP STEEL device heavy and non-portable. The large number of parts mounted to the base member and the bolts and nuts used to mount them also produce environments for bacterial growth which makes it difficult to keep the device clean and sanitary.

U.S. Pat. No. 4,934,110 issued to Juranitch back in 1990 discloses an edge sharpening apparatus having a panel with a slot and two pivotably curved sharpening steels attached to counterweights similar to U.S. Pat. No. 5,655,959. It also discloses, however, another embodiment in which the counterweights are replaced by coil springs that are connected between the pivotable plates attached to the sharpening steels and the panel member of the sharpening device. These coil springs act to pull the pivotable plates to impede the sharpening steels from pivoting under the force of the knife blade that is being sharpened. However, it was found in actual practice that these coil springs failed to provide enough tension and counterforce on the sharpening steels to allow them to provide sufficient pressure against the knife blade to sharpen its cutting edges. Moreover, the coil springs had a tendency to become separated from the knife sharpener device during operation, and contaminate meat that was being processed on an industrial line, or damage surrounding equipment like grinders or conveyor belts. For these reasons, this product design with coil springs failed in the commercial field, and springs were abandoned in favor of counterweights.

Therefore, it would be very advantageous to provide a sharpening apparatus that may be used by a relatively unskilled person to simultaneously sharpen the two opposed cutting edges of a knife blade by hand and to maintain a sharpened cutting edge along the blade with minimal effort and training. Such an apparatus should be small and portable so that the person may easily take it out to sharpen the cutting edges of the knife blade when needed, and small enough to be mounted in a stationary location where working space is limited and tight. Moreover, the device should enable the sharpening of the blade's cutting edges without having to maintain a specific swiping angle, or precisely adjust the position of cams to enable the sharpening steels to produce the desired cutting edge angle along the knife blade. Furthermore, the sharpening device should feature a relatively small number of parts without bolts and nuts to reduce surfaces on which bacteria can grow. Such a sharpening apparatus can be used to maintain an extremely sharp cutting edge for precise cutting of a material without crushing or other damage with significantly reduced physical force and strain upon the user.

SUMMARY OF THE INVENTION

A small, light-weight, and portable apparatus for the sharpening of the blade of a knife and maintaining the sharpened blade edge is provided according to the invention. The knife sharpener comprises a panel member having an elongated slot extending therein. A pair of attachment tabs is used to secure a pair of sharpening steels to the panel member along pivot points on opposite points of the slot without counterweights. The sharpening steels having an upper attachment end, a curved upper segment extending downwardly from the upper attachment end, and a straight lower end segment extending downwardly from the curved upper segment. The sharpening steels being swing downwardly in crossed relation about their pivot points along the slot in a plane adjacent and parallel to the plane of the panel member, the crossed relation defining an intersection point.

A pair of cams mounted to the front face of the panel member having a vertical slot therein. A pair of leaf springs is attached to the vertical slots in the cams. They have a bearing surface for abutting one of the sharpening steels to bias it into its standby position. The cams are preferably mounted to the panel member in a stationary manner to prevent movement of the leaf springs out of proper alignment with the sharpening steels during the knife sharpening operation.

When the knife blade is pushed downwardly in the slot of the panel member of the knife sharpener, it comes into contact with the intersection point of the crossed sharpening steels, the intersection point being moved lower along the slot, bowing the sharpening steels under tension against the bearing surfaces of the leaf springs. As the knife blade is drawn downwardly, outwardly, and through the slot, its cutting edges are sharpened by their engagement with the sharpening steels. The angle of the intersection point of the crossed sharpening steels should ideally be about 70 degrees. It has been found that such an angle permits the knife sharpener to automatically sharpen the cutting edges of the knife blade without the user having to know in advance the desired angle of the cutting edges, or match the knife's cutting edges with the surface of the sharpening steels. Thus, the knife blade can be readily sharpened with minimal skill or training by the user.

The knife sharpener can also include a wiper rod pivotably mounted to the panel member that overlays the panel board slot. When the knife blade is moved down the slot to be sharpened by the sharpening steels, it also engages the wiper rod to further polish the sharpened cutting edges of the knife. A counterweight is used to place the wiper rod under tension and impede the force applied by the knife blade against the wiper rod. However, this counterweight is considerably lighter than the counterweights used in prior art knife sharpeners.

The knife sharpener device of the present invention is small and portable. It may be worn on the person of the user where it may be conveniently be accessed as needed to sharpen a knife blade. It can also be easily used in tight quarters in an industrial production line. The knife sharpener comprises a relatively small number of parts without the bolts and nuts fasteners of prior art devices which can produce breeding grounds for bacteria.

DETAILED DESCRIPTION OF THE PREFERRED EMBODIMENT

Figure 1:
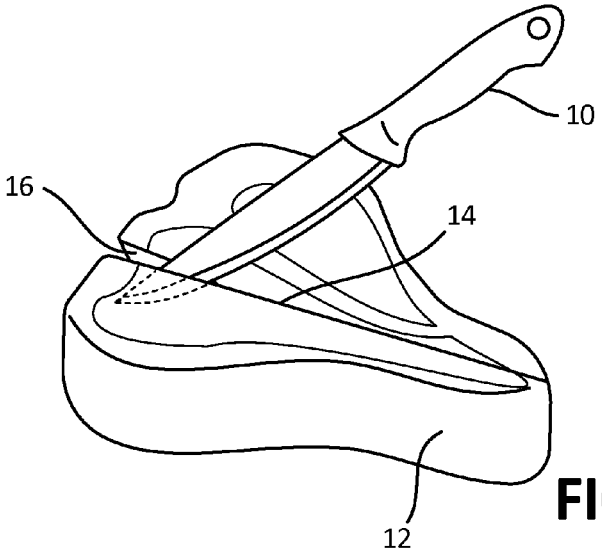
FIG. 1 is a perspective view of a knife cutting a material like a piece of meat.

A sharpening apparatus that may be used by a relatively unskilled person to simultaneously sharpen the two opposed cutting edges of a knife blade by hand and to maintain a sharpened cutting edge along the blade with minimal effort and training is provided by the invention. The apparatus comprises a panel member with a slot partially extending from its top edge. A pair of sharpening steels are pivotably mounted to the panel member, and they swing downwards in a crossed relation across the slot. A pair of leaf spring bias the sharpening steels in their standby position. When the knife blade is moved down through the slot, it comes into contact with crossed sharpening steels to bow them outwards under tension applied by the leaf springs. The cutting edges of the knife blade are drawn along and against the sharpening steels to automatically sharpen their cutting edges at the proper angle without any need to match angles between the cutting edges of the knife and the sharpening steels. A wiper rod biased by a counterweight can polish the sharpened cutting edges. With the absence of counterweights attached to the sharpening steels, as some prior art knife sharpeners require, the device is small and portable so that the person may easily take it out to sharpen the cutting edges of the knife blade when needed, and small enough to be mounted in a stationary location where working space is limited and tight. Moreover, the sharpening device features a relatively small number of parts without bolts and nuts to reduce surfaces on which bacteria can grow. Such a sharpening apparatus can be used to maintain an extremely sharp cutting edge for precise cutting of a material without crushing or other damage with significantly reduced physical force and strain upon the user.

For purposes of the present invention, "cut substrate" means a material such as paper, cardboard, metal foil, thin plastic, textiles, cloth, silk, rope, twine, wire, wood veneers, wood, construction materials, flowers, tree or plant part, or foods like meats that is capable of being cut or trimmed by a knife.

As used within this Application, "knife" means a hand-operated cutting tool with a cutting edge or blade and a handle for cutting or trimming a cut substrate. It can have a fixed blade or a blade that folds or slides into a slot in the handle. It includes, without limitation, except for serrated edges, knives used as dining utensils or in food preparation like a bread knife, boning knife, carving knife, chef's knife, cleaver, butcher's knife, electric knife, kitchen knife, oyster knife, paring or coring knife, rocker knife, steak knife, table knife, or ulu; knives used as tools like a Bowie knife, cobbler's or shoemaker's knife, crooked knife, wood carving knife, diver's knife, electrician's knife, hunting knife, linoleum knife, machete, palette knife, paper knife or letter opener, pocket knife, produce knife, rigging knife, scalpel, straight razor, survival knife, switchblade, utility knife, whittling knife, x-acto knife, balisong, or kiridashi; knives used as weapons like a ballistic knife, bayonet, combat knife, dagger, fighting knife, ramuri, shiv, trench knife, butterfly knife, or throwing knife; or knives used in religious ceremonies like an athame, kirpen, kilaya, his, kukri, puukko, seax, or sgiandubh.

FIG. 1 shows a knife 10 cutting a cut substrate in the form of a piece of meat 12 along an intended cut line 14. The produced cut line 16 is shown behind the travel path of the knife.

Figure 2:
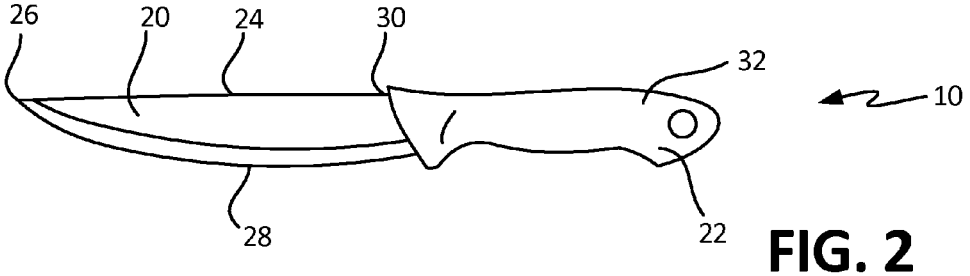
FIG. 2 is a perspective view of a knife.

The knife 10 is a hand-operated cutting tool that is shown more clearly in FIG. 2. It consists of a blade 20 and a handle 22. The blade 20 comprises a spine 24 constituting the thickest section of the blade, a point 26 located at the end of the blade, and a cutting edge 28 extending along the bottom surface of the blade from the point 26 to the heel 30. The hilt or butt 32 is formed by the end of the handle 22. The handle 22 used to grip or manipulate the blade 20 safely may include a tang constituting a portion of the blade opposite the point 26 that extends into the handle.

Figure 3:
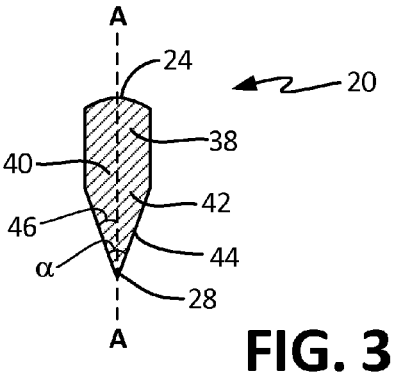
FIG. 3 is a cross-sectional view of the knife blade.

For purposes of the knife sharpener of this invention, the blade 20 should feature a plain edge, or a plain edge portion on a combination knife additionally featuring a serrated blade portion. The knife sharpener of the present invention sharpens and maintains the plain cutting edge of the knife. As shown more clearly in FIG. 3, the blade features a broad middle region 38 with the spine 24 along its top surface. The lower region 40 of the blade features a grind region 42 having a beveled edge 44 produced on one or both exterior surfaces at an edge angle 46 with respect to vertical axis A-A. This beveled edge 44 produces cutting edge 28 running along the bottom surface of the knife blade 12.

The knife blade 20 can be manufactured from a variety of different materials. Carbon steel constituting an alloy of iron and carbon can provide a very sharp cutting edge 28. It holds its edge well and is relatively easy to sharpen, but is also vulnerable to rust and stains. On the other hand, stainless steel constituting an alloy of iron, chromium, possibly nickel, and molybdenum with only a small amount of carbon will not accept quite as long lasting of a cutting edge 28 as carbon steel, but it remains highly resistant to corrosion. High-carbon stainless steel alloys contain a higher amount of carbon, and do not discolor or stain, while maintaining a sharper cutting edge. Titanium metal is characterized by a better strength-to-weight ratio. It is therefore more wear resistant and more flexible than steel. Titanium metal is often heat-treated to produce the necessary hardness required for a longer-lasting cutting edge 28 for the knife blade.

The total included angle $\alpha$ of the knife blade 20 extends from one side of the blade to the other side. Thus, it is double the edge angle 46 for a double-ground knife blade. Unfortunately, this included angle varies widely between different types of knives or cutting apparati. This included angle $\alpha$ is about 20 degrees for razors, pairing knives, and fillet knives that constitute some of the sharpest of cutting blades. Most kitchen knives like utility/slicing knives, chef's knives, boning knives, and carving knives should have an included angle of about 30-50 degrees. Japanese-style knives feature a sharper cutting edge 28 defined by an included angle of about 28-32 degrees. Sporting knives like pocket knives, survival knives, and hunting knives usually feature an included angle of about 50-60 degrees. This shallower angle produces a broader lower region 42 having more metal material on the knife blade which produces a more durable cutting edge 28 for use in the field. Machetes, chisels, draw knives, and axes are typically sharpened to an included angle of about 60-80 degrees for even greater durability. This varying included angle makes it difficult to sharpen the cutting edges of a particular knife by prior art sharpening devices where the desired angle must be known and the device adjusted to produce that angle.

Figure 4:
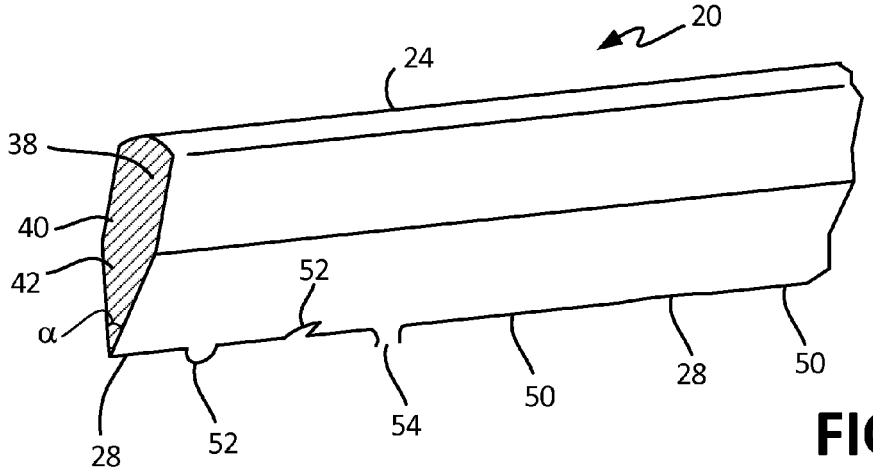
FIG. 4 is a partial perspective view of the knife blade with deformed edges and burrs along its blade.

But, cutting edge 28 along the bottom surface of the knife blade does need to be maintained in a sharpened state that accommodates its designated included angle. As shown more clearly in FIG. 4, this cutting edge should be maintained in a state with a continuous, straight edge 50 along the length of the blade. But through usage, especially if the knife 10 is used to cut or slide hard objects like bone, ice, or construction materials, portions of this cutting edge 28 may become deformed. Such deformations within the cutting edge may create an outwardly deflected region 52 towards either side of the blade 20. Such deformations cause a "dulled edge" along the knife blade that produces a poor cut by the knife 10. Even more critically, a deformed region 52 may become worse in its deflection over time to the point that its metal separates from the knife blade 20 to form a burr 54 along the cutting edge 28. Such outwardly deflected deformations 52 or burrs 54 will require significantly greater force exerted by the user upon the knife blade 20 to cut or slice, pulling or crushing a cut substrate being cut, and thereby fail to produce a neat and uniform cut. If the knife is used to cut the stem of a flower or plant, these deformations and burrs can crush the edge of the stem to make the flower or plant susceptible to disease or shorten its life.

While a piece of meat 12 has been shown as the piece of cut material cut by the knife 10 for the sake of illustration, a number of other types of cut materials that can be cut or sliced by a knife like skin, plastic, textiles, paper, film, and hobby or construction materials are possible, and should be understood as being fully covered by the scope of this invention.

Figure 5:
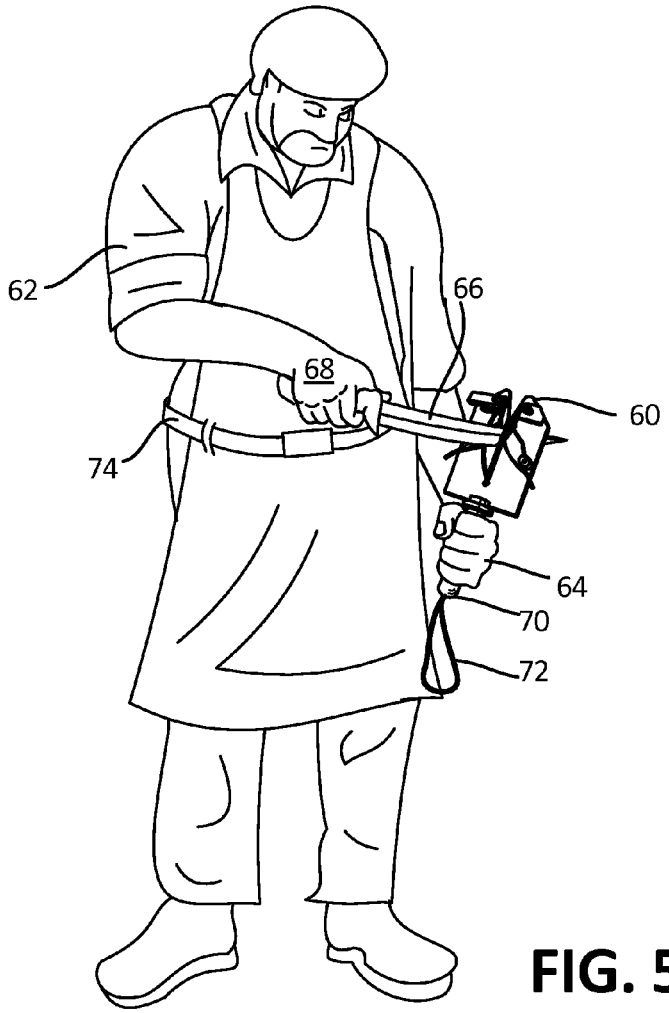
FIG. 5 is a perspective view of the knife sharpener device and a knife held by a user with the user and knife shown in phantom lines.

The knife sharpener device 60 of the present invention is shown in FIG. 5 held by a user 62. This person is grasping the knife sharpener 60 with his left hand 64, while grasping a knife 66 that needs to be sharpened with his right hand 68. The knife sharpener 60 has a handle 70 that allows the device to be easily picked up and manipulated. The knife sharpener 60 can be comfortably carried or worn on the user's person, such as via a strap or cord 72 attached to a belt 74 worn by the user 62, or it can be stored or conveniently mounted near the person at a site, such as a meat processing line or butcher shop, or any other location or industrial site where a knife must be kept sharp.

Figure 6:
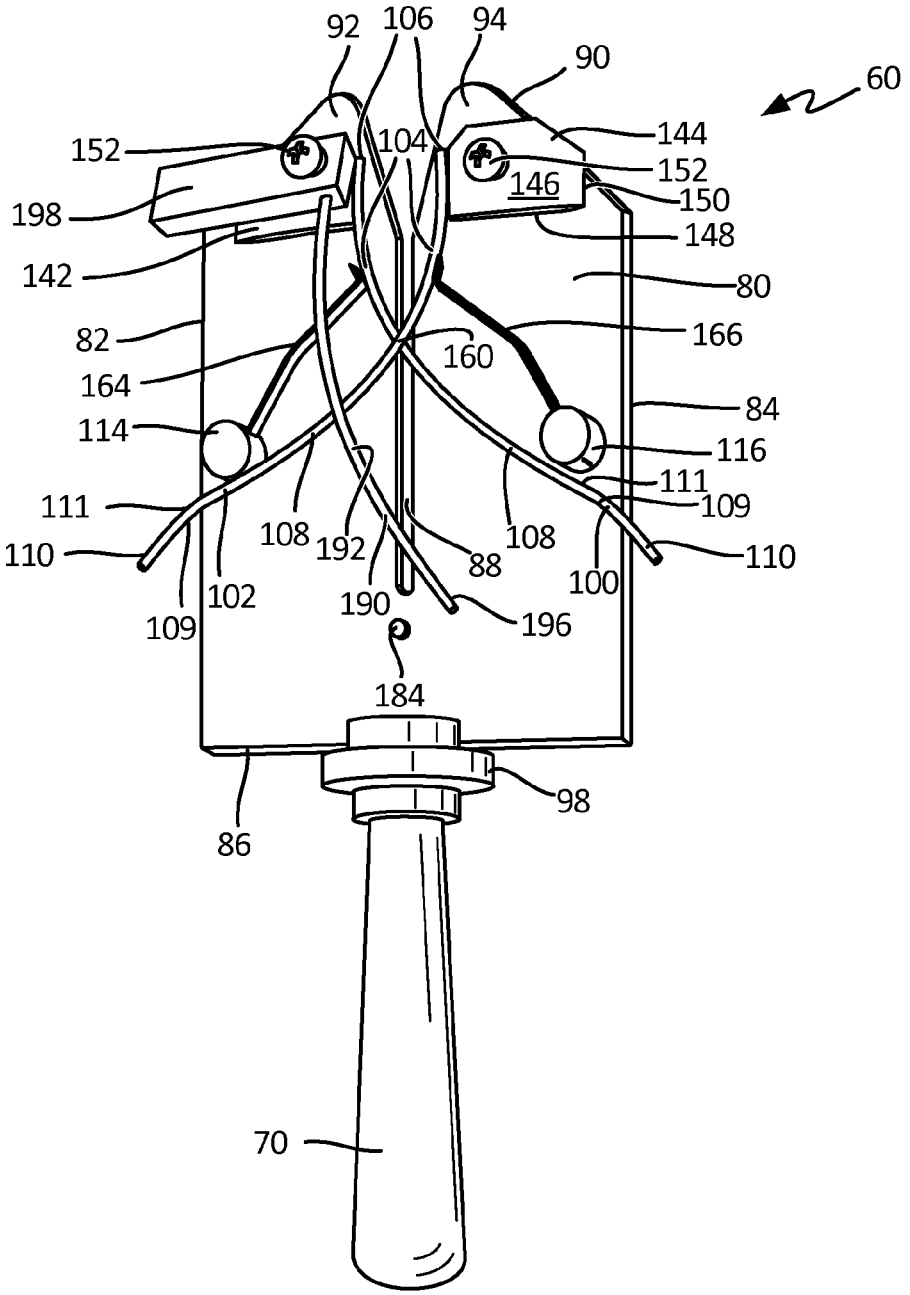
FIG. 6 is front elevation view of the knife sharpener device of the present invention.

The knife sharpener 60 is shown more clearly in FIGS. 6-10. As seen in FIG. 6, it comprises a panel member 80 to which is attached handle 70. The panel is made from any appropriate material that will withstand knife cuts without undue damage, and approved by industry standards such as the United States Department of Agriculture for the meat industry, while avoiding damaging the knife blade in return. The material should also be readily washable and subject to sterilization since, depending upon the environment in which the knife 66 is being used, it may transfer dirt, grime, debris, food material, construction material, bacteria, etc. from the knife 66 to the knife sharpener 60. Moreover, the material used for the panel member 80 needs to be relatively soft and non-abrasive to avoid blunting, chipping, or other damage caused to the knife blade during the sharpening operation. Wood like hardwoods with tight grains and small pores or bamboo, plastics like polyethylene or high-density polyethylene, rubber, or steel are examples of such a material useful for the panel 80.

Figure 7:
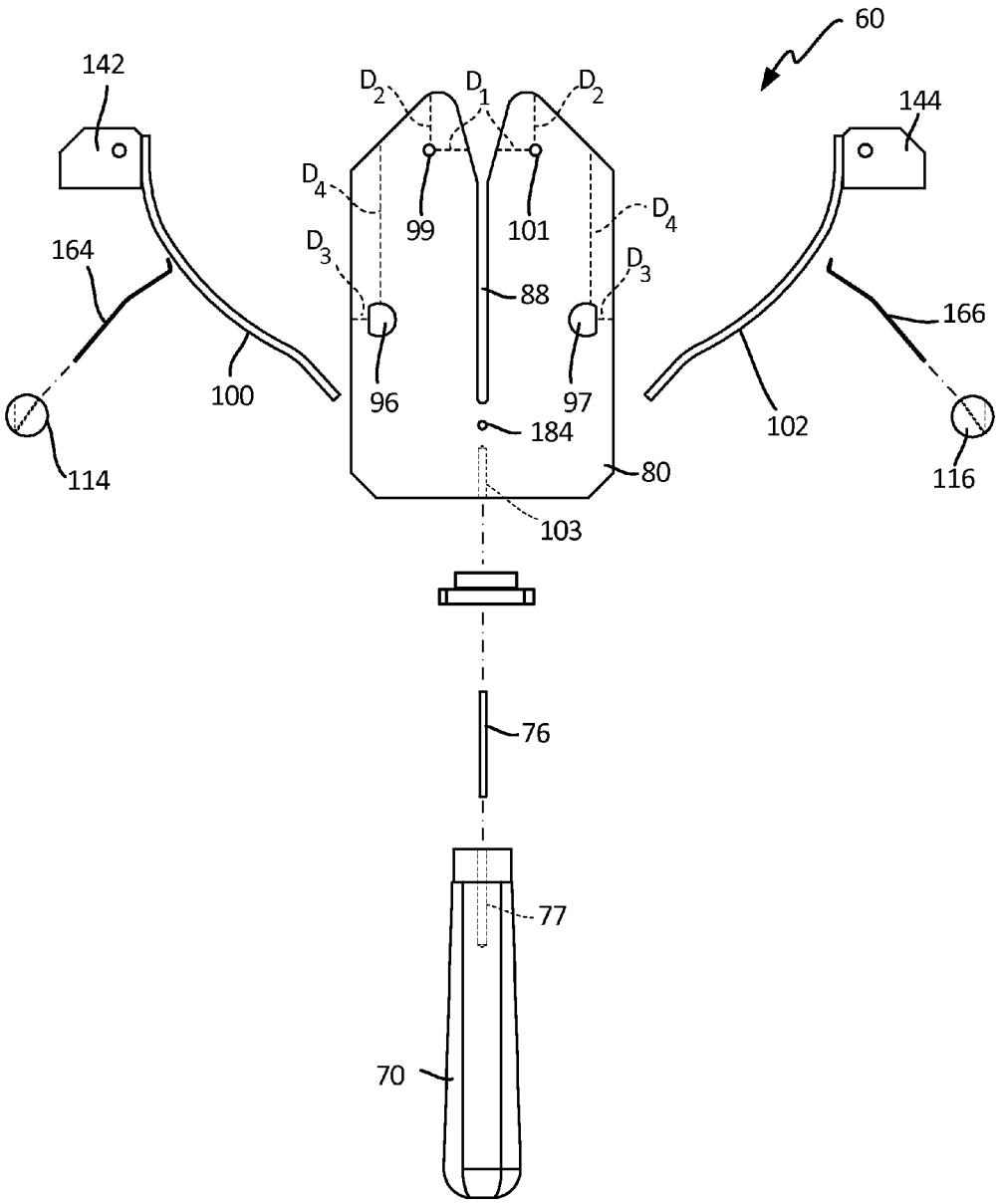
FIG. 7 is an exploded view of the panel member, handle, attachment tabs, and sharpening steels of the knife sharpener of FIG. 6.
Figure 8A:
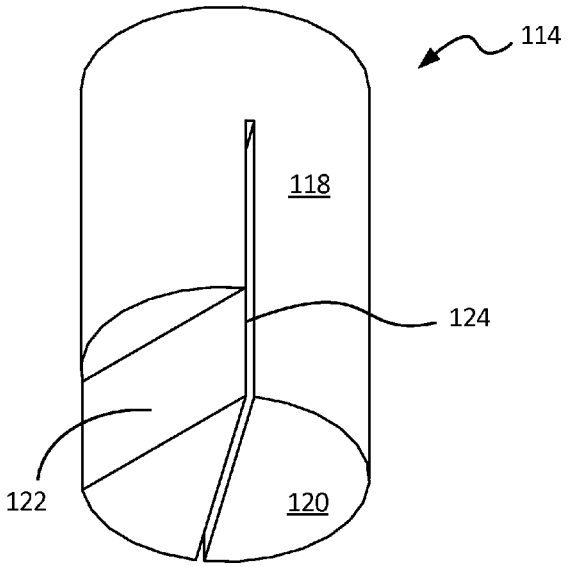
FIG. 8A is a perspective, upwards view of the left-hand stationary cam.
Figure 8B:
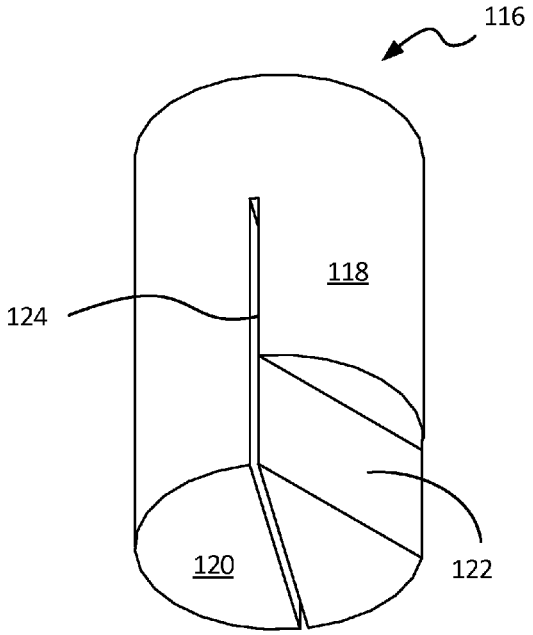
FIG. 8B is a perspective, upwards view of the right-hand stationary cam.

As shown more clearly in FIG. 7, the panel member 80 comprises a left edge 82, right edge 84, and bottom edge 86. A slot 88 is formed in the panel to partially bisect it from the top edge 90. This slot should be sufficiently wide to accommodate the width of the knife blade without jamming the knife or otherwise impeding its downward travel along slot 88 during the sharpening operation. Slot 88 bisects top edge 90 of panel member 80 to define upper left region 92 and upper right region 94 on the panel member.

Located on the panel member 80 near the left edge 82 and right edge 84 are a pair of D-shaped niches 96 and 97. These niches extend only partially through the width of the panel member 80 and feature a flat surface. The niches 96 and 97 should be positioned the same distance $D_1$, from the edge of the panel member 80, and the same distance $D_2$ from the top edge 90 of the panel member.

Also located on the upper left region 92 and upper right region 94 of the panel member 80 are a pair of through holes 99 and 101, respectively. These through holes 99 and 101 should be positioned the same distance $D_3$ from the edge of the panel member 80, and the same distance $D_4$ from the top edge 90 of the panel member.

Extending partially into the panel member 80 from the bottom surface 86 is channel 103. This channel has a diameter that closely accommodates the diameter of pin 76. The pin is typically fit into the channel of the panel board to be securely engaged, while extending from the bottom surface of the panel board.

Handle 70 features a channel 77 extending partially into the handle from its upper end 98. This channel 77 should have a diameter slightly smaller than the diameter of pin 76. In this manner, pin 76 is inserted into channel 77 to securely attach panel member 80 to handle 70.

Handle 70 may additionally feature a slot 78 formed within the top edge 90 of the handle to accommodate the width of panel member 80. When the panel member is fitted into slot 78 of the handle with pin 76 securely engaging channel 103 of the panel member and channel 77 of the handle, then a strong connection between the panel member and handle is produced without the need for a screw or bolt whose head can provide a breeding ground for bacteria.

The handle may be made from a different material than the material of the panel. For example, panel 80 can be formed from high-density polyethylene polymer, a nylon material, or an acetyl polyoxymethylene polymer (sometimes called DELRON), while handle 70 is made from wood. Alternatively, the panel 80 and handle can be made from the same material. The panel and handle can also form an integrated whole, such as being extruded from the high-density polyethylene, nylon, or DELRON polymer.

Pivotably mounted upon the panel member 80 are a pair of attachment tabs 142 and 144. As shown more clearly in FIGS. 7 and 12, these attachment tabs 142 and 144 comprise a thickened piece of stainless steel material approximately 100/1000-inch thick having equal masses. Holes 146 and 148 are formed within attachment tabs 142 and 144, respectively. These holes 146 and 148 are positioned distance $D_5$ from the inside edge 143 of the attachment tabs and distance $D_6$ from the top edge 145 of the attachment tabs.

A threaded insert (not shown) is fitted inside left through hole 99 and right through hole 101 in panel member 86. Bolts 152 having a threaded shank extend through holes 146 and 148 in the attachment tabs 142 and 144, respectively, and into threaded engagement with the threaded inserts of the through holes to pivotably mount the attachment tabs to the panel board. These bolts 152 define the rotational exes for the attachment tabs.

Figure 9:
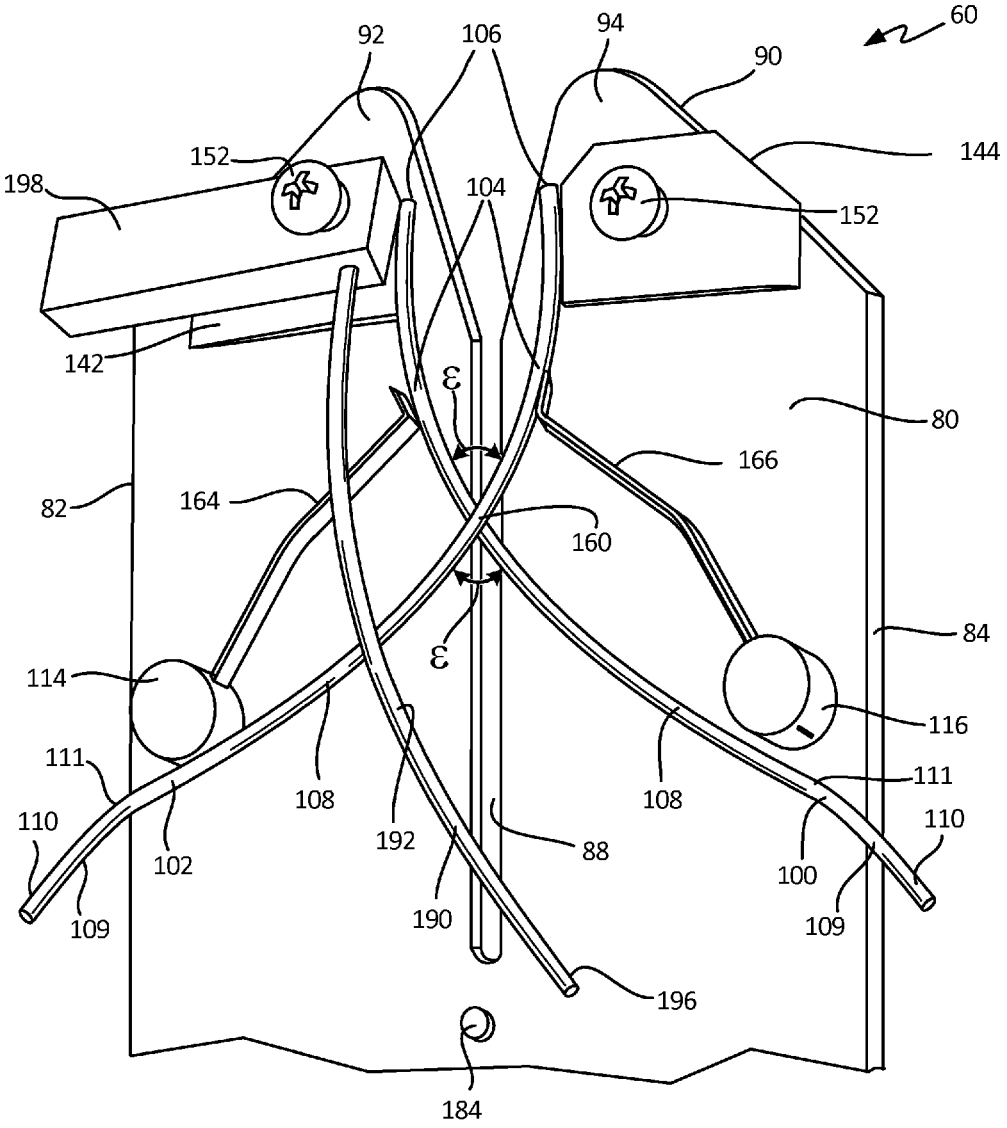
FIG. 9 is a partial front elevation view of a portion of the knife sharpener of FIG. 6.
Figure 10:
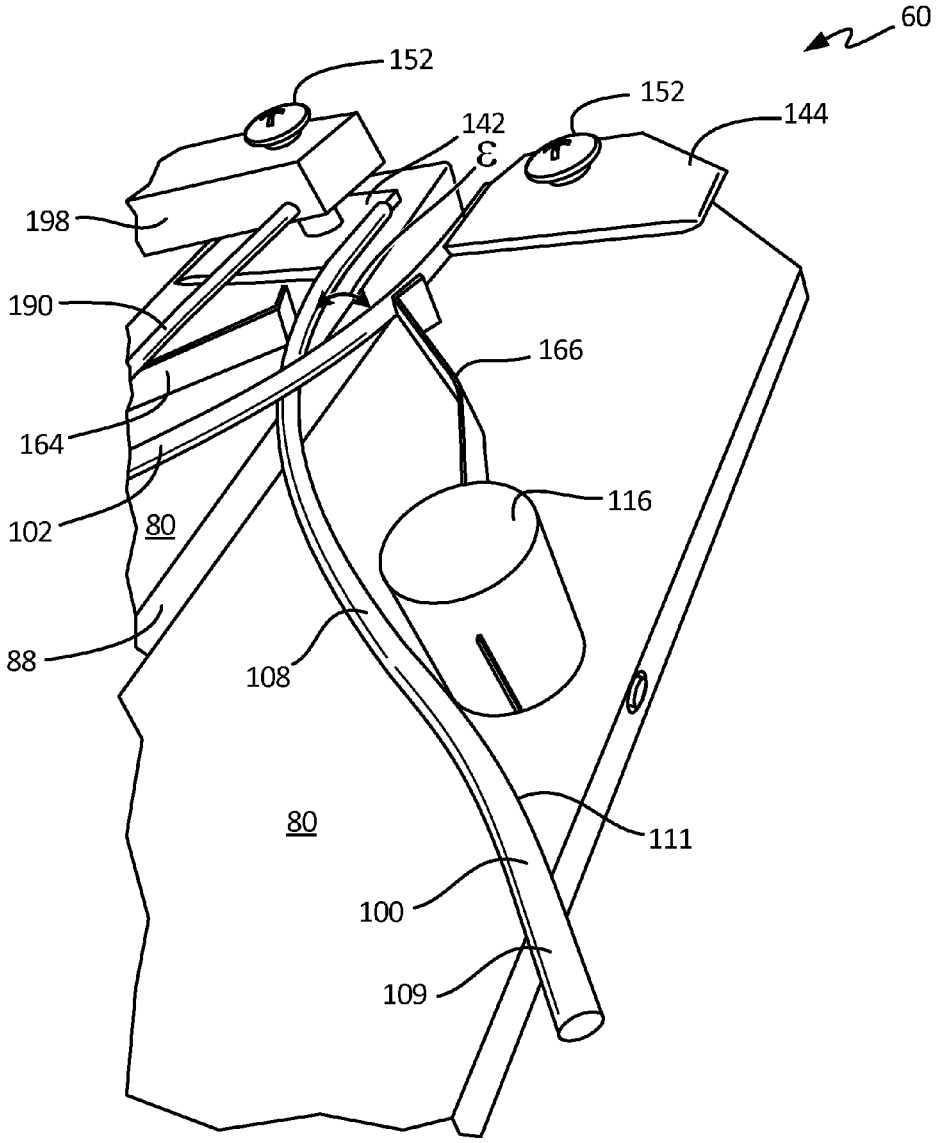
FIG. 10 is a partial perspective view of a portion of the knife sharpener of FIG. 6.

A pair of sharpening steels 100 and 102 are fixedly connected along their attachment ends 106 to the inside edges 143 of attachment tabs 142 and 144, respectively. As shown in FIGS. 6 and 9-10, the left-hand sharpening steel 100 and right-hand sharpening steel 102 overlay panel member 80. These two sharpening steels each have a roughly circular cross section, although other shapes like an oval or triangle may be used. The sharpening steels 100 and 102 extend toward each other in criss-crossed relation, intersecting at point 160 along slot 88.

The sharpening steels 100 and 102 represent a honing steel, sometimes referred to as a "sharpening steel," "sharpening rod," "sharpening stick," or (in the food or cooking industry) a "butcher's steel" or "chef's steel." They comprise a rod made from hardened steel, stainless steel or stainless steel alloy, diamond-coated steel, or ceramic. When made from a carbon-containing stainless steel material like 440 C alloys (sourced, for example, from Discount Steel of Minneapolis, Minn.) or ceramic, they bear a smoothly, highly polished exterior surface. Optionally, they may include a plurality of longitudinal ridges. When made from diamond-coated steels, the steel material is embedded with abrasive diamond particles. Suitable diamond-coated steel or ceramic materials may be sourced from the Norton affiliate of Saint-Gobain Corporation of Courbevoie, France. But, the material from which the sharpening steels 100 and 102 are fabricated must have a higher tensile strength than the metal from which the knife blade 20 is made, or else it must be treated to a surface hardening process.

Extending upwards from the surface of panel member 80 near the left edge 82 and right edge 84 are stationary cams 114 and 116, respectively. These stationary cams may bear any suitable shape such as a cylinder or cube. As shown more clearly in FIGS. 8A and 8B, each cam bears an exterior surface 118 and a bottom surface 120. A cut-out niche 122 formed in the side wall causes bottom surface 120 to be D-shaped. A slot 124 extends vertically within the cam from the bottom surface 120.

The stationary cams 114 and 116 are press-fitted into left niche 96 and right niche 97, respectively, in panel member 80. The perimeter and surface area of the bottom surface 120 of the cam is slightly larger than the perimeter and bottom surface area of the panel member niche, so that the cam is securely connected to the panel board 80 without the need for a bolt or screw that could otherwise provide a breeding ground for bacteria. The cooperating straight side and corners of the D-shaped profiles of the cams and niches act to inhibit the cam from rotating within respect to the panel member. This stationary feature for the cam ensures that slot 124 will be maintained at an approximately 35 degree angle with respect to slot 88 on the panel member 80.

Figure 12:
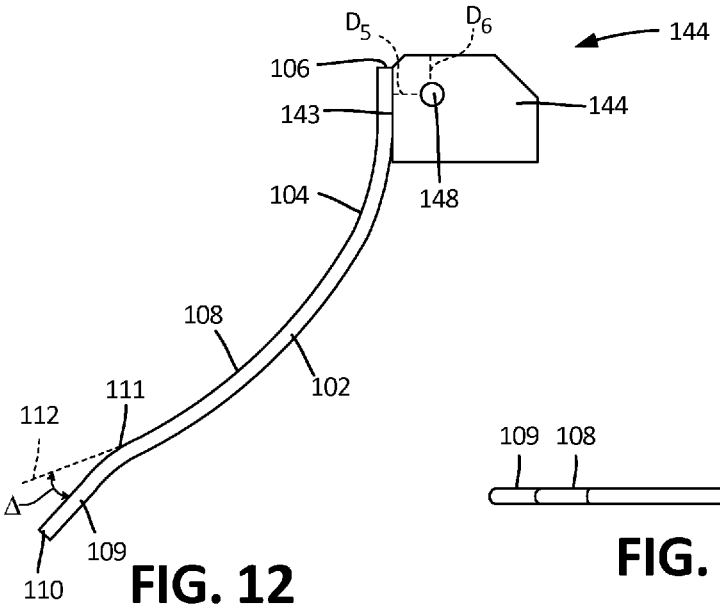
FIG. 12 is a frontal view of the attachment tab and right-hand sharpening steel.
Figure 13:
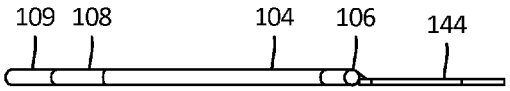
FIG. 13 is a top plan view of the attachment tab and sharpening steel of FIG. 12.
Figure 14:
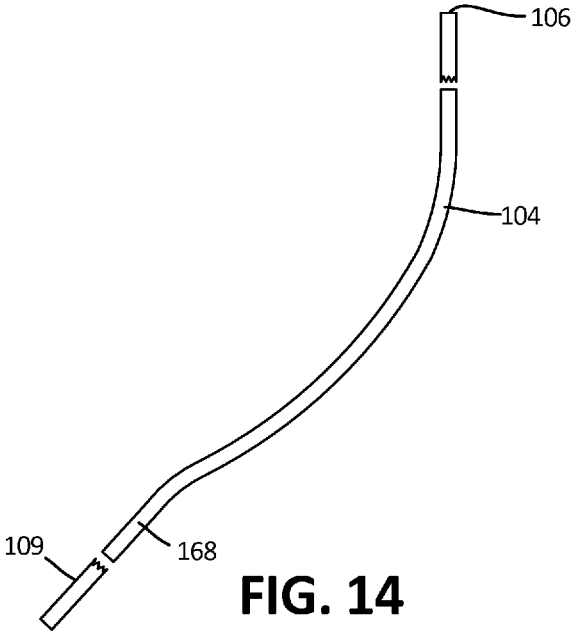
FIG. 14 is a deconstructed view of the sharpening steel.

As is shown in FIGS. 6, 9, and 12, each of the sharpening steels 100 and 102 has a terminal segment 109 that is relatively straight as compared with the concave segment 104, and extends away from the upward curvature of the concavely-shaped segment 104. The terminal segment 109 is convexly curved downwardly slightly beyond a straight orientation, and is connected to the upper concave segment 104 by a slightly more convex intermediate segment 108. As a consequence, the concavity of the upper segment 104 terminates at the intermediate segment 108, and the terminal segment 109 extends at an angle Δ to the tangent 112 line at its point of termination of concavity. This point of termination of concavity is at the point where intermediate segment 108 joins upper segment 104. Bend point 111 on the sharpening steel is defined by this transition from intermediate segment 108 to terminal segment 109. The angle Δ should be about 36-70 degrees preferably about 40-55 degrees, most preferably about 48 degrees. The upper segment 104 is fixedly secured to the inside edge 143 of the attachment tab 142, 144, such as by a weld.

Once attachment clips 142 and 144 are secured to panel member 80 as described above, the arced upper segment 104 of the sharpening steels 100, 102 curves along and above the top surface of panel member 80, passing over slot 88. Meanwhile, straight intermediate segment 108 of sharpening steel 100, 102 passes along and above the top surface of panel member 80 below cams 114, 116. Distal end 110 of the sharpening steel 100, 102 extends beyond the cams. As shown in FIG. 6, sharpening steel 102 is positioned above sharpening steel 100, so that they cross over each other at intersection point 160 over slot 88.

Figure 11:
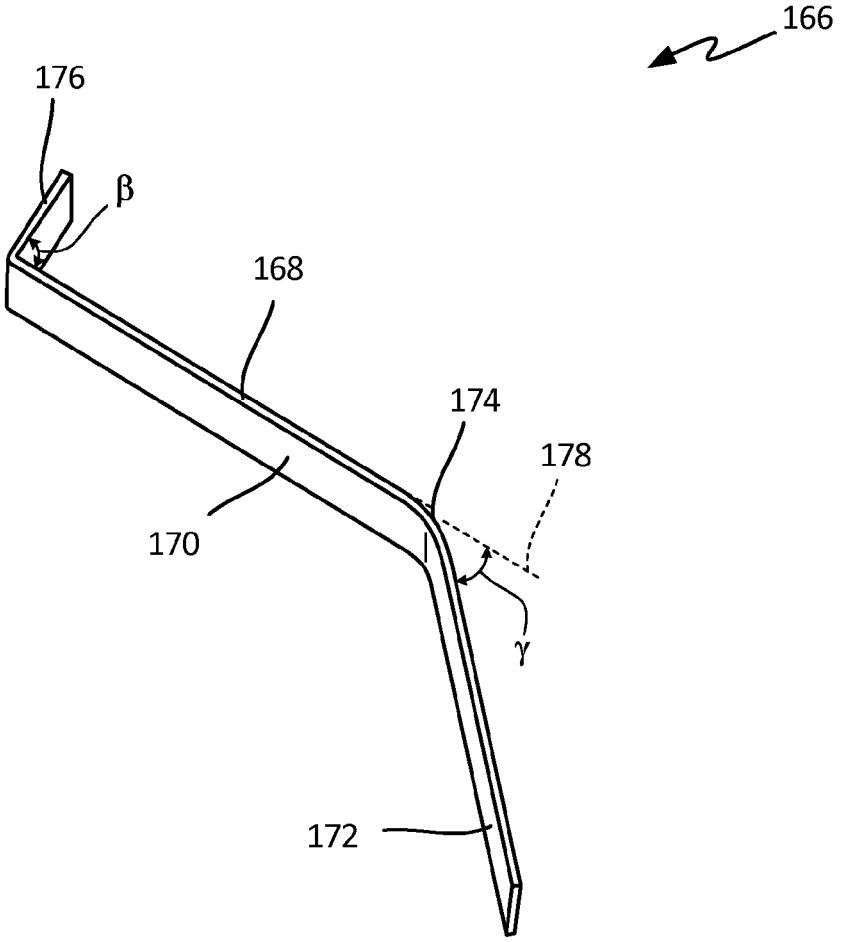
FIG. 11 is a perspective view of an elliptical leaf spring.

The knife sharpener 60 also comprises elliptical leaf springs 164 and 166. As shown more clearly in FIG. 11, elliptical leaf spring 166 comprises a rectangular strip 168 of metal material having the required combination of rigidity and elasticity to act like a spring. The strip 168 comprises a first segment 170 that leads into a second segment 172 along a bend 174. Tail 176 is connected to the end of first segment 170, bent away from the first segment at an angle β of about 100-110 degrees, preferably about 102-106 degrees, most preferably about 104 degrees. Second segment 172 is bent away from first segment 170 at an angle γ with respect to tangent line about 178 of 9-36 degrees, preferably about 15-20 degrees, most preferably about 18 degrees. Such an elliptical leaf spring 166 is made from "spring steel" material that may be sourced from W.S. Grainger, Inc. of Lake Forest, Ill., or McMaster-Carr Supply Company of Elmhurst, Ill. Elliptical leaf spring 164 is manufactured in the same manner as elliptical spring leaf 166, as described above.

As shown in FIG. 6, elliptical leaf springs 164 and 166 are assembled onto knife sharpener 60 with the end of their respective second segments 172 inserted into slot 124, of cams 114 and 116. When the cam with the end of the leaf spring inserted into the slot is press fitted into the niche in the panel member, the two portion of the body of the cam adjacent to the slot will be pushed towards each other by the perimeter walls of the niche, thereby tightly holding the spring end in place. Extending from the cams with their respective first and second segments positioned above panel member 80, their first tails 176 abut the arced upper segments 104 of sharpening steels 100 and 102.

Figure 15A:
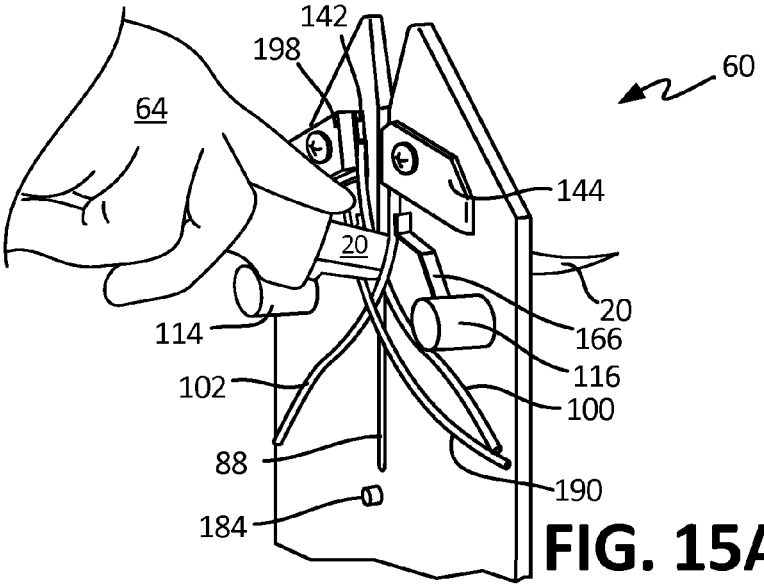
FIG. 15A is a partial perspective view of the knife sharpener of FIG. 6 with the sharpening steels and wiper rod in their standby positions, and the knife blade first engaging the sharpening steels.
Figure 15B:
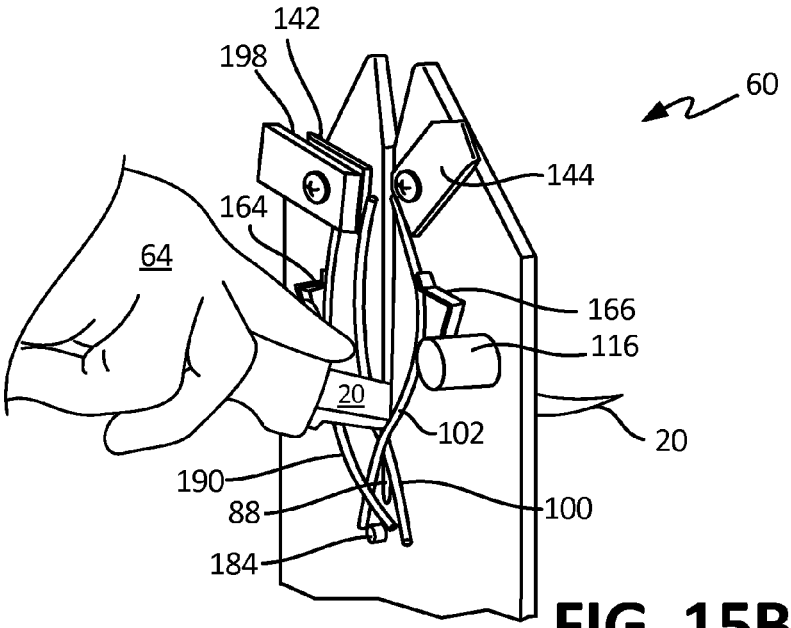
FIG. 15B is a partial perspective view of the knife sharpener of FIG. 10A with the knife blade further progressed along the sharpening steels and wiper rod.

When the sharpening steels 100 and 102 are in their standby position, elliptical leaf springs 164 and 166 push the sharpening steels 100 and 102 upwardly towards the top edge 90 of panel with intermediate segments 108 abutting stationary cams 116 and 114, respectively, to hold the sharpening steels in a stationary position. As shown in FIG. 15A, the user 62 inserts knife blade 20 into slot 88 of the panel member 80 from its top edge 90, and pushes the knife blade 20 down through the slot until it meets intersection point 160 of the two sharpening steels 100 and 102. Continued application by hand 64 of downwards force upon knife blade 20 causes the intersection point 160 of the sharpening steels 100 and 102 to likewise move in a downwards direction, as shown in FIG. 15B. The upper curved segments 104 of the sharpening steels will bow outwardly against tails 178 of leaf springs 164 and 166, while the terminal segments 109 are drawn towards each other until they or the distal ends 110 of the sharpening steels come into contact with stop post 184 extending from the top surface of panel member 80. At the same time, the user's hand 64 draws the knife blade towards the user so that the beveled edges 44 of the knife blade 20 are slid along the intermediate segments 108 of the sharpening steels 100 and 102. In this matter, deformed edges 52 of the knife blade 20 are realigned to produce a sharpened cutting edge 28. When pressure is applied on the knife blade against the hard sharpening steels, it causes the blade's metal to yield to the harder sharpening steel metal or ceramic material of the sharpening steel to become realigned and thus sharpened. The elliptical leaf springs 164 and 166 provide impedance against the downwards movement of the sharpening steels 100 and 102 to prolong the contact by the knife blade with the sharpening steels.

The slot 88 of the panel member 80 properly orients the knife blade 20 with respect to the sharpening steels 100 and 102. The leaf springs orient the sharpening steels with respect to the slot and knife blade, and keep proper tension on the sharpening steels during the sharpening operation. The stationary cams properly orient the springs at an angle of about 35 degrees with respect to the slot.

The angle ϵ at the intersection point 160 of the criss-crossed sharpening steels should be about 50-80 degrees, preferably about 65-75 degrees, most preferably about 70 degrees. Moreover, this intersection angle ϵ will be roughly maintained throughout the sharpening operation. It has been found that this angle allows the cutting edge of the knife blade to be sharpened at the correct angle for that knife without any need to match angles between the cutting edge and sharpening steels or make adjustments to the sharpening device, as is required by prior art devices. The distances $D_3$ and $D_4$ for the placement of the through holes 99 and 101 in the panel board 80, and the distances $D_5$ and $D_6$ for placement of the holes 146 and 148 in the attachment tabs 142 and 144 should be correctly defined at the point of manufacture to produce this desired intersection angle ϵ for the sharpening steels 100 and 102 pivotably mounted to the panel member via the attachment tabs.

Yet, the sharpening steel surface must also be super smooth in order to avoid further damage and deformation caused by the sharpening steel to the knife blade that could cause unwanted burrs along the blade edge. Thus, the sharpening steels do not function like grinding wheels, whetstones, or hones that are commonly used to remove metal burrs from a blade before it can be sharpened. At the same time, the two sharpening steels 100 and 102 simultaneously treat the opposite beveled edges 44 of the knife blade to realign the cutting edge 28. Because of the cylindrical surface of the sharpening steels 100 and 102, they sharpen the cutting edge without any need to maintain the knife blade at a specified angle with respect to the sharpening surface unlike with prior art processes. This enables unskilled persons to sharpen knife blades using the knife sharpener device 60 of the present invention.

Optionally attached to knife sharpener 60 is wiper rod 190. Constituting a sharpening steel in its own right, it has a gradually curved main body 192 with an attachment end 194 and a distal end 196. The attachment end 194 is secured to a counterweight 198 comprising a slab 200 of metal with a hole 202 in it. Counterweight 198 is secured to panel 80 by means of a bolt extending through the hole 202 and a corresponding hole (not shown) in the panel 80. As shown in FIG. 6, the same bolt 152 may be used to secure both attachment tab 142 and counterweight 198 to panel member 80. Counterweight 198 only weighs 2-6 ounces, preferably 3 ounces. This is much lighter than the counterweights used in the MOUSETRAP STEEL prior art knife sharpener that weigh 20 ounces each.

When assembled, the curved body 192 of wiper rod 190 extends from its attached end 194 and counterweight 198 over and above panel member 80 and sharpening steel 102 and slot 88 with its distal end 196 extending adjacent to or past right edge 84 of panel 80 (see FIG. 10A). When the knife blade 20 is pushed downwards through slot 88 to contact the sharpening steels 100 and 102 at intersection point 160 and continued to push the sharpening steels in a downwards direction (see FIG. 15B), the knife blade 20 will contact wiper rod 190 to also push it down. By drawing the knife blade along wiper rod 190 in addition to sharpening steels 100 and 102, the wiper rod 190 will act to polish the sharpened cutting edge 28 produced by the sharpening steels 100 and 102 to further straighten any imperfections along the cutting edge. At the same time, counterweight 198 provides impedance against the downward movement of the wiper rod to prolong the contact by the knife blade with the wiper rod. There is no leaf spring biasing the wiper rod.

When the knife blade is withdrawn from the slot 88 in the knife sharpener 60, the tails 178 of the elliptical leaf springs 164 and 166 will act to bias sharpening steels 102 and 100, respectively, back to their stand-by position shown in FIG. 15A. Meanwhile, counterweight 198 acts to return wiper rod 190 to its standby position. The knife sharpener 60 is now ready to sharpen the cutting edge along the blade 20 of the same knife 10 or another knife.

Sharpening steels normally cannot repair burrs or other severely deformed regions along a knife blade cutting edge. They just realign less severely deformed regions. However, in the case of the present invention, the sharpening steels 100 and 102 allow such a repair step to be carried out. A bend 111 exists within the sharpening steel 100, 102 where the straight intermediate segment 108 joins the terminal segment 109. This bend provides additional surface area on the sharpening steel. As seen in FIG. 15B, the stop post 184 is properly located on the panel member 80 so that when the terminal segments 109 or distal ends 110 of the sharpening steels abut the stop post to arrest the inward movement of the steels when the knife blade is pressing down on the steels, the intersection point 160 of the criss-crossed sharpening steels is defined by the two bend points 111. When the knife blade 20 is pushed down in the slot 88 to engage this intersection point 160, the stop post 184 will lock the two sharpening steels in place so that further pressure is applied by the bends 111 of the sharpening steels against the burr or severely deformed region of the cutting edge of the knife blade to repair it. The polished exterior of the sharpening steels and locked position of the steels produces this extra sharpening capacity by the knife sharpener 60.

The knife sharpener 60 is very small in size. It measures about four inches wide and about six inches long. It only weighs about ten ounces. Because of this very small size and weight, it can be conveniently suspended from the belt 74 or belt loop of the user 62 so that it is readily available to sharpen a knife no matter where the user stands in a work place environment.

The above specification and associated drawings provide a complete description of the structure and operation of the scissors sharpener of the present invention. Many alternative embodiments of the invention can be made without departing from the spirit and scope of the invention. Therefore, the invention resides in the claims herein appended.

I claim:

1. A knife sharpener for sharpening the blade of a knife used to cut a substrate, said knife having a blade with opposed cutting edges, said knife sharpener comprising:

(a) a panel member having a front surface and a top edge, and an elongated slot extending partially therein from the top edge;

(b) a pair of attachment tabs, each of which is pivotably secured to the panel member at a pivot point adjacent to and on opposite sides of the upper end portion of the slot;

(c) a pair of sharpening steels having an upper attachment end, a curved upper segment extending downwardly from the upper attachment end, and a straight lower end segment extending downwardly from the curved upper segment, each of the sharpening steels being connected at its attachment end to one of the attachment tabs secured to the panel member, and each of the sharpening steels being swingable downwardly in crossed relation about its pivot point along the slot in a plane adjacent and parallel to the plane of the panel member, the crossed relation defining an intersection point;

(d) a pair of cams mounted to the front face of the panel member having a vertical slot therein;

(e) a pair of leaf springs having a first end and a second end, the first end being secured by the vertical slot in one of the cams, and the second end terminating in a bearing surface, the bearing surface of a spring abutting one of the sharpening steels to place tension on and impede the movement of the sharpening steel;

(f) wherein the leaf springs push the crossed sharpening steels upwardly into their standby position when the knife blade is not engaged; and (g) wherein as the knife blade is pushed downwardly in the slot of the panel member to contact the intersection point of the crossed sharpening steels, the intersection point is moved lower along the slot, bowing the sharpening steels under tension against the bearing surface of the leaf springs, the sharpening steels sharpening the opposing cutting edges of the knife blade as the knife blade is drawn downwardly, outwardly, and through the slot.

2. The knife sharpener of claim 1, wherein the cams maintain the leaf spring at an angle with respect to the slot in the panel member of about 35 degrees.

3. The knife sharpener of claim 1, wherein the cams are mounted in a stationary manner to the panel member to prevent the leaf springs from pivoting with respect to the sharpening steels during the knife sharpening operation.

4. The knife sharpener of claim 1, wherein the leaf spring comprises a first segment and a second segment with a bend in between, an angle defined at the bend between the first segment and a tangent line extending from the second segment of about 9-36 degrees.

5. The knife sharpener of claim 1, wherein the angle defined by the bend between the first segment and the bearing surface of the leaf spring is about 100-110 degrees.

6. The knife sharpener of claim 1, wherein an angle defined by the intersection point of the crossed sharpening steels is about 50-80 degrees.

7. The knife sharpener of claim 6, wherein the angle is about 70 degrees.

8. The knife sharpener of claim 6, wherein the attachment tabs of the sharpening steels are mounted to the panel member at positions on adjacent sides of the slot to define and maintain the angle of the intersection point of the crossed sharpening steels.

9. The knife sharpener of claim 1, wherein the sharpening steels are made from hardened steel, stainless steel, stainless steel-carbon alloy, diamond-coated steel, or ceramic material.

10. The knife sharpener of claim 1, wherein the sharpening steels have a cross-sectional shape of a circle, oval, or triangle.

11. The knife sharpener of claim 1 further comprising a stop post mounted to the face of the panel member and below the slot for arresting the inward movement of the sharpening steels during the knife sharpening operation.

12. The knife sharpener of claim 1 further comprising a straight terminal segment extending downwardly from the straight lower end segment at a bend point on the sharpening steel, wherein when the bend points on the two crossed sharpening steels define the intersection point, and the knife is pushed downwardly in the slot of the panel member to contact the intersection point, a more severely damaged region along the cutting edge of the knife blade can be repaired as it is drawn downwardly, outwardly and through the slot.

13. The knife sharpener of claim 12, wherein an angle defined at the bend in the sharpening steel between the terminal segment and a tangent line extending from the lower end segment is about 36-70 degrees.

14. The knife sharpener of claim 13, wherein the angle is about 48 degrees.

15. The knife sharpener of claim 1 further comprising a wiper rod having an upper attachment end, and a curved segment extending downwardly from the upper attachment end, the wiper rod being connected at its attachment end to a counterweight pivotably secured to the panel member, and the wiper rod being swingable downwardly about its pivot point along the slot in a plane adjacent and parallel to the plane of the panel member, wherein the wiper rod comes into contact with the knife blade during the sharpening operation to polish the cutting edges sharpened by the sharpening steels.

16. The knife sharpener of claim 1 further comprising a handle connected to the bottom edge of the panel member.

17. The knife sharpener of claim 1, wherein the knife sharpener is sufficiently small and portable to be worn on the person of the user.

18. The knife sharpener of claim 1, wherein the cut substrate comprises paper, cardboard, metal foil, thin plastic, textiles, cloth, silk, rope, twine, wire, wood veneers, wood, construction materials, flowers, tree or plant part, or foods like meats.

19. The knife sharpener of claim 1, wherein the knife comprises a knife used as a dining utensil or in food preparation like a bread knife, boning knife, carving knife, chef's knife, cleaver, butcher's knife, electric knife, kitchen knife, oyster knife, paring or coring knife, rocker knife, steak knife, table knife, or ulu; a knife used as a tool like a Bowie knife, cobbler's or shoemaker's knife, crooked knife, wood carving knife, diver's knife, electrician's knife, hunting knife, linoleum knife, machete, palette knife, paper knife or letter opener, pocket knife, produce knife, rigging knife, scalpel, straight razor, survival knife, switchblade, utility knife, whittling knife, x-acto knife, balisong, or kiridashi; a knife used as a weapon like a ballistic knife, bayonet, combat knife, dagger, fighting knife, ramuri, shiv, trench knife, butterfly knife, or throwing knife; or a knife used in religious ceremonies like an athame, kirpen, kilaya, kris, kukri, puukko, seax, or sgiandubh.

20. The knife sharpener of claim 1, wherein the included angle of the knife blade to be sharpened is about 20-80 degrees.

* * * * *